US008132895B2

(12) United States Patent
Tomizawa et al.

(10) Patent No.: US 8,132,895 B2
(45) Date of Patent: Mar. 13, 2012

(54) PRINTHEAD SUBSTRATE, PRINTHEAD, HEAD CARTRIDGE, AND PRINTING APPARATUS

(75) Inventors: Keiji Tomizawa, Yokohama (JP); Masaki Oikawa, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 548 days.

(21) Appl. No.: 12/415,045

(22) Filed: Mar. 31, 2009

(65) Prior Publication Data

US 2009/0251509 A1 Oct. 8, 2009

(30) Foreign Application Priority Data

Apr. 3, 2008 (JP) ..... 2008-097478

(51) Int. Cl.
*B41J 2/05* (2006.01)

(52) U.S. Cl. ..... 347/57; 347/17

(58) Field of Classification Search ..... 347/14, 347/17, 18, 19, 20, 54, 57, 58
See application file for complete search history.

(56) References Cited

U.S. PATENT DOCUMENTS 6,445,244 B1 * 9/2002 Stratakos et al. ..... 327/540
6,652,055 B2 11/2003 Oikawa
2005/0206685 A1 9/2005 Hirayama
2005/0212857 A1 9/2005 Hirayama
2007/0211095 A1 9/2007 Hirayama

FOREIGN PATENT DOCUMENTS

JP 2000-246900 A 9/2000

* cited by examiner

*Primary Examiner* — Juanita D Jackson
(74) *Attorney, Agent, or Firm* — Fitzpatrick, Cella, Harper & Scinto

(57) ABSTRACT

This invention is directed to a head substrate capable of high-quality printing even when the environmental temperature, print duty, and printhead itself change, a printhead, a head cartridge, and a printing apparatus using the printhead. The head substrate includes a plurality of heaters, a constant electric current source which generates a constant electric current used to drive the heaters, and a reference current generation circuit which generates a reference current for generating the constant electric current. The head substrate also includes a MOSFET which drives the heaters by the constant electric current obtained by driving the constant electric current source in accordance with the reference current, and a switch which determines the time for which the reference current is generated. The open-close time of the switch can be externally controlled.

11 Claims, 15 Drawing Sheets

PRINTHEAD SUBSTRATE, PRINTHEAD, HEAD CARTRIDGE, AND PRINTING APPARATUS

BACKGROUND OF THE INVENTION

1. Field of the Invention

The present invention relates to a printhead substrate, printhead, head cartridge, and printing apparatus. Particularly, the present invention relates to a printhead substrate which is used to print according to an inkjet method and has a circuit for driving a heater by supplying a predetermined current to it according to a constant electric current method, a printhead, a head cartridge, and a printing apparatus.

2. Description of the Related Art

There has conventionally been known an inkjet printhead which prints by generating thermal energy from heaters arranged in the nozzles of a printhead, bubbling ink near the heaters using the thermal energy, and discharging ink from the nozzle by the bubbles. The inkjet printhead will be simply referred to as a printhead.

Recently, inkjet printing apparatuses using the printheads are required to achieve higher speeds and higher resolutions. To meet these requirements, the printhead integrates a larger number of nozzles at higher density. When driving heaters in the printhead, as many heaters as possible need to be simultaneously driven at high speed in terms of the print speed.

In general, many heaters and their driving circuits are formed on a single semiconductor substrate (this substrate will be called a head substrate). The heater driving circuit is formed by a MOS semiconductor process which can form smaller devices at higher density by a simpler manufacturing process at lower cost than by a conventional bipolar semiconductor process.

As a new heater driving method coping with high-speed printing and the MOS manufacturing process, the United States Patent Application Publication Nos. 2005/0212857 and 2005/0206685 propose heater driving methods using a predetermined current.

FIG. 13 is a circuit diagram showing the arrangement of the heater driving circuit of a printhead proposed in the United States Patent Application Publication No. 2005/0206685.

As is apparent from FIG. 13, the heater driving circuit includes a reference voltage circuit 105, voltage-to-current conversion circuit 104, and current source block 106. The current source block 106 is formed from m heater groups each including x heaters. Although not shown, one printhead has n current source blocks. Hence, one printhead has a total number of (x×m×n) heaters.

The reference voltage circuit 105 generates a reference voltage $V_{ref}$ serving as a reference for the voltage-to-current conversion circuit 104. The voltage-to-current conversion circuit 104 converts a voltage into a current on the basis of the reference voltage $V_{ref}$ from the reference voltage circuit 105, generating a reference current $I_{ref}$ from the reference voltage $V_{ref}$.

Based on the reference current $I_{ref}$ generated by the voltage-to-current conversion circuit 104, a reference current generation circuit (not shown) generates a plurality of reference currents proportional to the reference current $I_{ref}$. These reference currents are supplied to the n current source blocks, respectively.

By using a corresponding one of reference currents IR1 to IRn, constant electric current sources $\mathbf{103}_1$ to $\mathbf{103}_m$ in each of the n current source blocks output constant electric currents Ih1 to Ihm proportional to the reference current supplied to the constant electric current sources.

As shown in FIG. 13, the current source block 106 includes (x×m) heaters, switching elements 102 as many as the heaters, and constant electric current sources $\mathbf{103}_1$ to $\mathbf{103}_m$ of m groups. In FIG. 13, in order to individually refer to the (x×m) switching elements 102, a suffix "$_{ij}$" (i=1 to m, j=1 to x) is added to the reference numeral. When referring to the switching elements 102 as a whole, the suffix will be omitted.

The switching element 102 controls short-circuit and open-circuit of a current between terminals in accordance with a control signal from the control circuit of the printing apparatus main body. (x×m) heaters 101 and the switching elements 102 belong to m groups each including x heaters 101 and x switching elements 102. In these groups, the heaters $\mathbf{101}_{11}$ to $\mathbf{101}_{mx}$ and the switching elements $\mathbf{102}_{11}$ to $\mathbf{102}_{mx}$ for controlling driving of the respective heaters are series-connected. In each group, power supply terminals are commonly connected to a power supply line 110, and ground terminals are commonly connected to a GND line 111 via constant electric current sources. In FIG. 13, in order to individually refer to the m groups, a suffix is added like 106-1, 106-2, . . . , **106-*m*. When referring to the m groups as a whole, they will be denoted by the reference numeral "106**", and the suffix will be omitted.

The output terminals of the constant electric current sources $\mathbf{103}_1$ to $\mathbf{103}_m$ provided in correspondence with the m groups 106 are connected to the common connection terminals of the corresponding groups 106 in which the heaters 101 and switching elements 102 are series-connected. Driving control of a current to the heaters is executed by turning on/off the switching elements 102 in each group in accordance with a control signal. Output currents Ih1 to Ihm from the constant electric current sources $\mathbf{103}_1$ to $\mathbf{103}_m$ provided in accordance with the respective groups are supplied to desired heaters.

In an actual printhead, a plurality of (n) current source blocks 106 having the same arrangement are provided, and the heater driving operation of each current source block 106 is the same as that described above. The n current source blocks 106 perform the same operation to drive any desired ones of (x×m×n) heaters and generate heat. There is known a control circuit in which a reference current generator $I_{ref}$ is connected to a switch and selects a constant electric current to be supplied to a heater, as disclosed in Japanese Patent Laid-Open No. 2000-246900. There is also known a printhead which changes the value of a reference current generated using a print data signal input from the outside of the head substrate, as disclosed in the United States Patent Application Publication No. 2007/0211095.

However, the conventional techniques suffer the following problems.

(1) Unstable Discharge and Discharge Failure in Low-Temperature Environment

When the temperature in an environment where the printing apparatus is installed is excessively low (e.g., 10° C. or less), the ink viscosity increases, the discharge becomes unstable, and in the worst case, a discharge failure occurs.

(2) Difference in Rise Characteristic of Head Temperature Depending on Print Duty The temperature rise characteristic of the head substrate differs between printing of a high-density image and that of a low-density image, and the ink discharge state changes. As a result, dot formation for a high-density image and that for a low-density image differ from each other, degrading the image quality.

(3) Difference in Rise of Head Temperature Derived from Difference in Set Current Value between Head Substrates The electrical resistance of a printing element (heater) varies owing to manufacturing variations of head substrates.

To generate a predetermined thermal energy by the printing element, the value of a current flowing through the printing element needs to be changed. For this purpose, a reference current (to be referred to as a set current value hereinafter) serving as the reference of a current to be supplied to the printing element is changed for each printhead. The heat generation amount of a reference current generation circuit differs between head substrates, and the temperature rise differs between them. When the printhead is changed, density unevenness or the like appears in a printed image, changing tonality.

SUMMARY OF THE INVENTION

Accordingly, the present invention is conceived as a response to the above-described disadvantages of the conventional art.

For example, a head substrate, printhead using the head substrate, head cartridge integrating the printhead, and printing apparatus using the printhead according to this invention are capable of high-quality printing even when the environmental temperature, print duty, and printhead itself change.

According to one aspect of the present invention, preferably, there is provided a head substrate comprising: a plurality of printing elements; a constant electric current source which generates a constant electric current used to drive the plurality of printing elements; a reference current generation circuit which generates a reference current for generating the constant electric current; a switching element which drives the plurality of printing elements by the constant electric current obtained by driving the constant electric current source in accordance with the reference current generated by the reference current generation circuit; a switch which determines a time for which the reference current is generated; and a sensor which detects a temperature, wherein an open-close time of the switch is externally controlled in accordance with the temperature detected by the sensor.

According to another aspect of the present invention, preferably, there is provided a printhead using the head substrate having the above-described arrangement.

According to still another aspect of the present invention, preferably, there is provided a head cartridge which integrates the printhead and an ink tank containing ink to be supplied to the printhead.

According to still another aspect of the present invention, preferably, there is provided a printing apparatus which uses the inkjet printhead or head cartridge having the above-described arrangement, and prints by discharging ink onto a printing medium.

The invention is particularly advantageous since the time for which the reference current is generated is changed in accordance with, for example, a detected temperature, the print duty, and a characteristic reflecting the manufacturing variations of printheads, thereby adjusting the heat generation amount of a reference current generation circuit. Accordingly, the head substrate is warmed up appropriately, and the temperatures of the head substrate and printhead are stabilized. High-quality printing can be achieved regardless of the temperature, the duty, and the individual difference of the printhead.

Further features of the present invention will become apparent from the following description of exemplary embodiments with reference to the attached drawings.

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Furthermore, unless otherwise stated, the term "printing element (nozzle)" generally means a set of a discharge orifice, a liquid channel connected to the orifice and an element to generate energy utilized for ink discharge.

A head substrate (substrate for a printhead) in the description not only includes a simple substrate made of a silicon semiconductor, but also broadly includes an arrangement having elements, wires, and the like.

The expression "on a substrate" not only includes "on an element substrate", but also broadly includes "on the surface of an element substrate" and "inside of an element substrate near its surface". The term "built-in" in the invention not only includes "simply arrange separate elements on a substrate", but also broadly includes "integrally form and manufacture elements on an element substrate by a semiconductor circuit manufacturing process or the like".

In the present invention, the terms "constant electric current" and "constant electric current source" mean a predetermined current supplied to printing elements regardless of the number of simultaneously driven printing elements and a current source to supply the current to the printing elements. The current value itself, which should be constant, includes a value changed and set to a predetermined current value. That is, the present invention includes heat flux control (bubbling control).

<Description of Inkjet Printing Apparatus (FIG. 1)>

Figure 1:
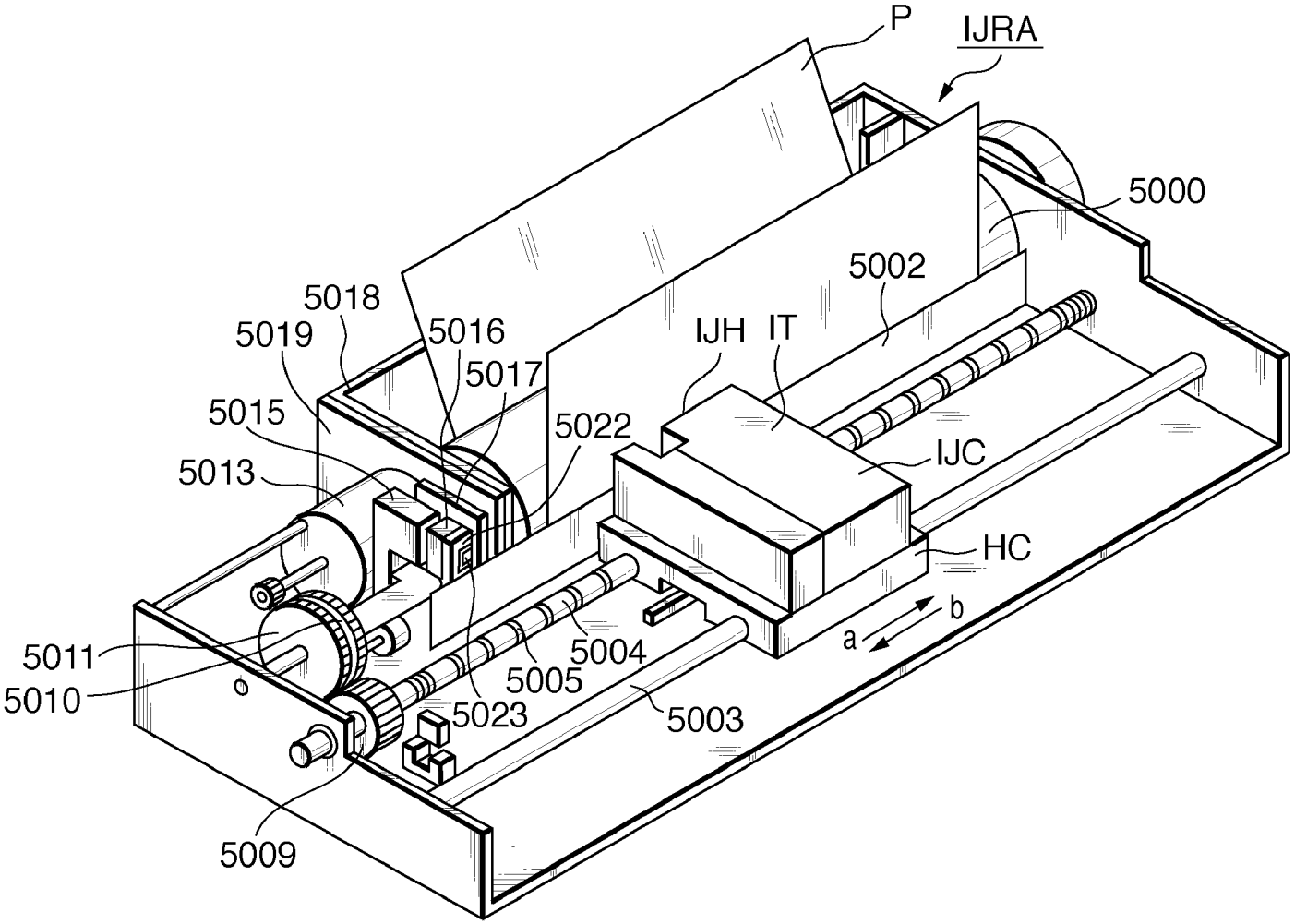
FIG. 1 is a perspective view showing the schematic outer appearance of the structure of a carriage and its periphery in an inkjet printing apparatus as an exemplary embodiment of the present invention.

FIG. 1 is a perspective view showing the schematic outer appearance of an inkjet printing apparatus as a typical embodiment of the present invention. Referring to FIG. 1, a lead screw 5004 rotates via driving force transmission gears 5009 to 5011 interlockingly with forward/reverse rotation of a carriage motor 5013. A carriage HC has a pin (not shown) engaged with a helical groove 5005 of the lead screw 5004. The carriage HC reciprocates in directions indicated by arrows a and b along with the rotation of the lead screw 5004 while being supported by a guide rail 5003. The carriage HC supports an inkjet cartridge IJC. The inkjet cartridge IJC includes an inkjet printhead IJH (to be referred to as a printhead hereinafter) and an ink tank IT containing printing ink.

The inkjet cartridge IJC integrates the printhead IJH and ink tank IT.

A paper press plate 5002 presses a paper sheet against a platen 5000 in the carriage moving direction. The platen 5000 is rotated by a conveyance motor (not shown) to convey a printing sheet P. A member 5016 supports a cap member 5022 which caps the front of the printhead. A suction means 5015 sucks the interior of the cap to do suction recovery of the printhead via an opening 5023 in the cap. A main body support plate 5018 supports a cleaning blade 5017 and a member 5019 which can move the blade back and forth.

Figure 2:
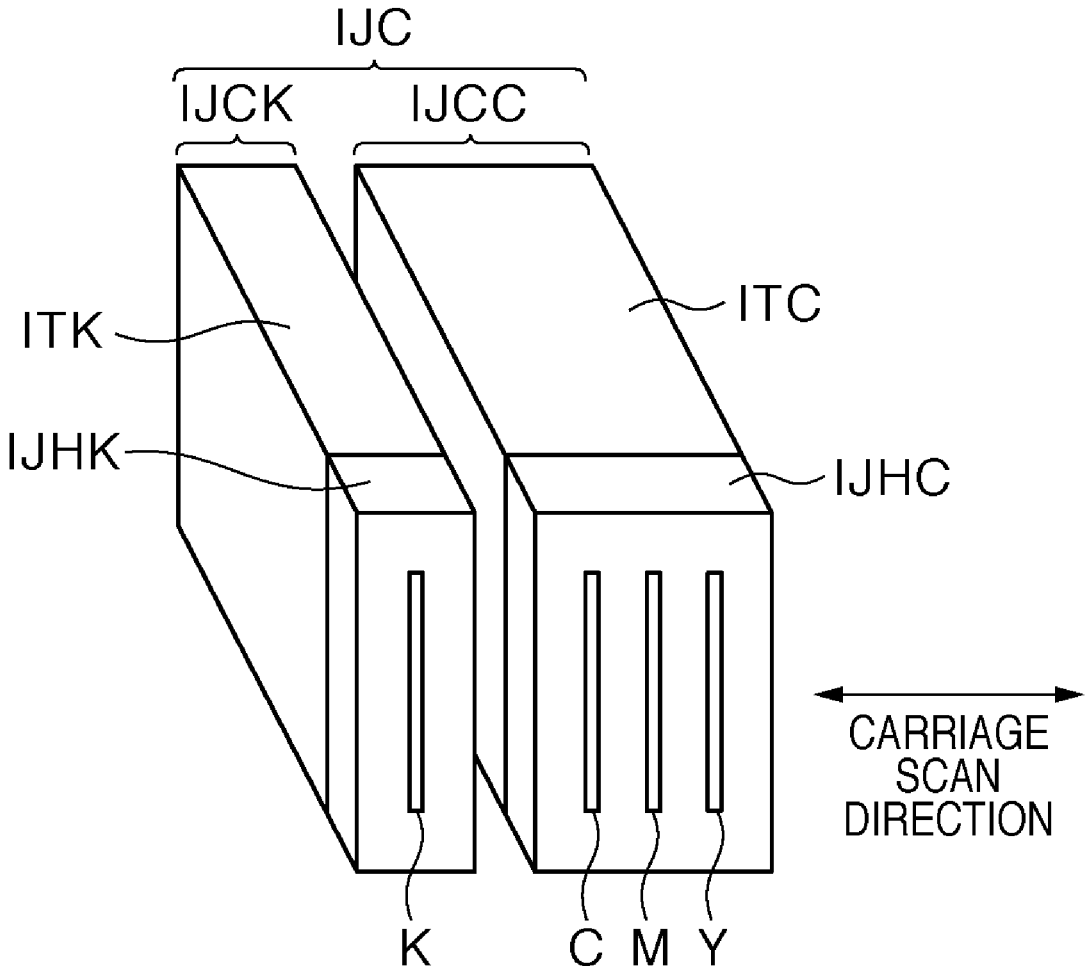
FIG. 2 is a perspective view showing the outer appearance of the detailed structure of an inkjet cartridge IJC.

FIG. 2 is a perspective view showing the outer appearance of the detailed structure of the inkjet cartridge IJC.

As shown in FIG. 2, the inkjet cartridge IJC includes a cartridge IJCK which discharges black ink, and a cartridge IJCC which discharges three, cyan (C), magenta (M), and yellow (Y) color inks. The two cartridges can be separated from each other and also detached from the carriage HC independently.

The cartridge IJCK includes an ink tank ITK containing black ink and a printhead IJHK which discharges black ink to print. The ink tank ITK and printhead IJHK are integrated. Similarly, the cartridge IJCC includes an ink tank ITC containing three, cyan (C), magenta (M), and yellow (Y) color inks and a printhead IJHC which discharges the color inks to print. The ink tank ITC and printhead IJHC are integrated. In the embodiment, the ink tanks of the cartridges are filled with the inks.

The ink tanks and printheads of the cartridges IJCK and IJCC need not always be integrated, and may also be separated from each other.

The "printhead IJH" is used to mention both the printheads IJHK and IJHC as a whole.

As is apparent from FIG. 2, a nozzle array to discharge black ink, a nozzle array to discharge cyan ink, a nozzle array to discharge magenta ink, and a nozzle array to discharge yellow ink are arranged parallel to each other in the carriage moving direction. The nozzle array direction is perpendicular or diagonal to the carriage moving direction.

Figure 3:
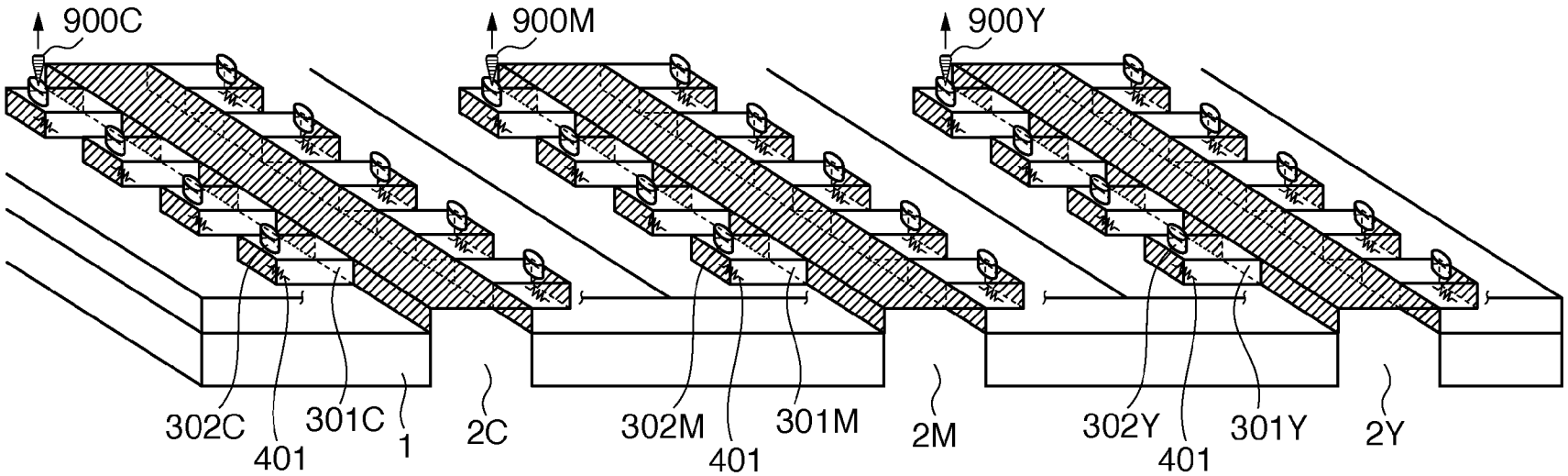
FIG. 3 is a perspective view showing the three-dimensional structure of a printhead IJHC which discharges three color inks.

FIG. 3 is a perspective view showing the three-dimensional internal structure of the printhead IJHC which discharges three color inks.

FIG. 3 clarifies the flow of ink supplied from the ink tank ITC. The printhead IJHC includes an ink channel 2C to supply cyan (C) ink, an ink channel 2M to supply magenta (M) ink, and an ink channel 2Y to supply yellow (Y) ink. Supply paths (not shown) to supply the inks to the ink channels from the lower surface of the substrate extend from the ink tank ITC.

Ink channels 301C, 301M, and 301Y are formed in correspondence with electrothermal transducers (heaters) 401. The C, M, and Y inks are guided to the electrothermal transducers (heaters) 401 on the substrate via the ink channels. When the electrothermal transducers (heaters) 401 are energized via a circuit to be described later, the inks on the electrothermal transducers (heaters) 401 receive heat and boil. As a result, ink droplets 900C, 900M, and 900Y are discharged from orifices 302C, 302M, and 302Y by the generated bubbles.

Referring to FIG. 3, electrothermal transducers (to be described later in detail), various kinds of circuits to drive them, memories, various kinds of pads serving as electrical contacts with the carriage HC, and various kinds of signal lines are formed on a printhead substrate (to be referred to as a head substrate hereinafter) 1.

An electrothermal transducer (heater) and a MOSFET to drive it will be generically referred to as a printing element. A plurality of printing elements will be generically referred to as a printing element unit.

FIG. 3 shows the three-dimensional structure of the printhead IJHC which discharges color inks. The printhead IJHK which discharges black ink also has the same structure. However, the size is ⅓ of the structure shown in FIG. 3. More specifically, the printhead IJHK has one ink channel, and the scale of the head substrate is also about ⅓.

A control arrangement for executing print control of the above-described printing apparatus will be described next.

Figure 4:
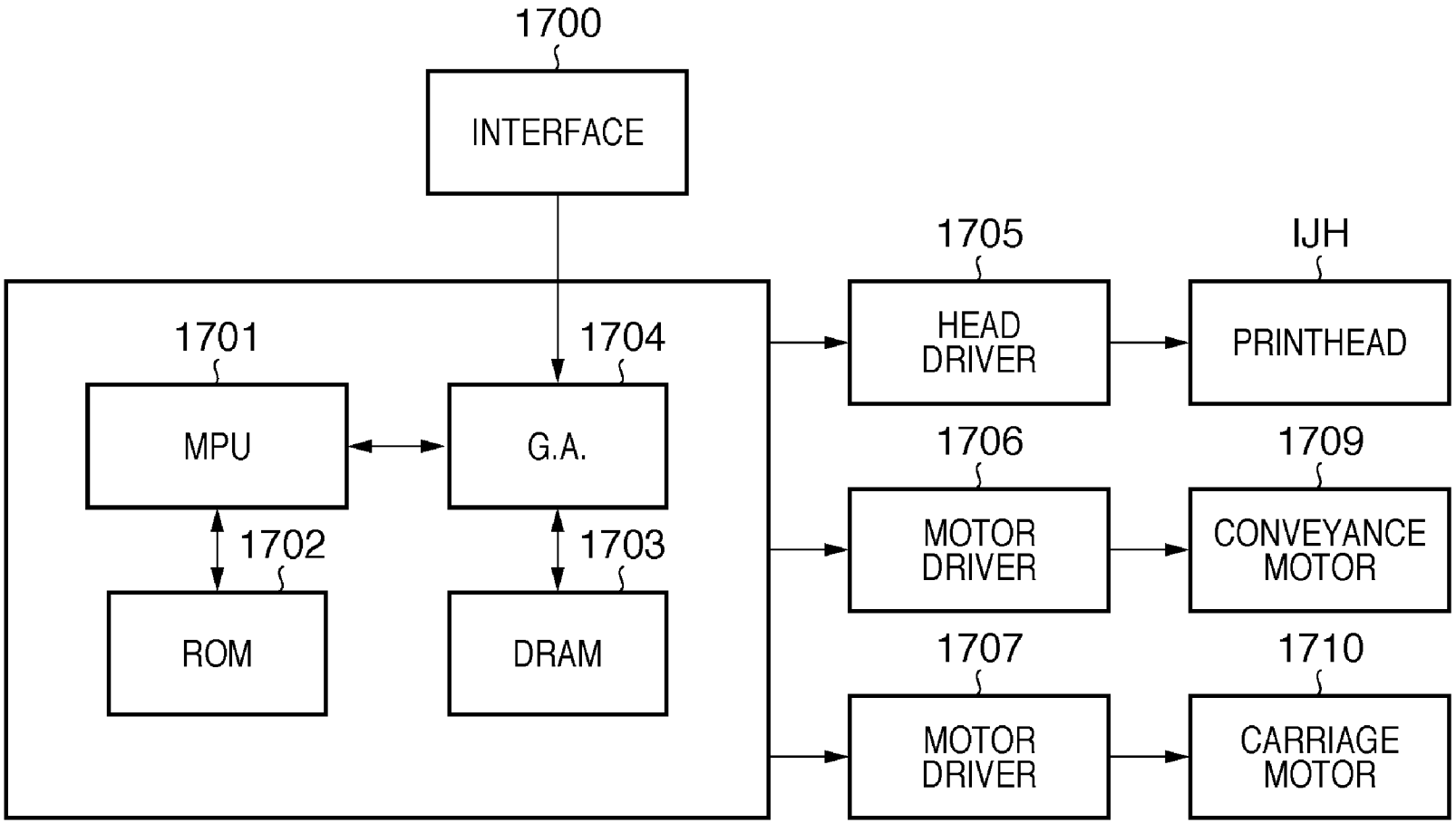
FIG. 4 is a block diagram showing the control arrangement of the printing apparatus shown in FIG. 1.

FIG. 4 is a block diagram showing the arrangement of the control circuit of the printing apparatus.

Referring to FIG. 4, an interface 1700 receives a print signal, and a ROM 1702 stores a control program to be executed by an MPU 1701. A DRAM 1703 saves various kinds of data (e.g., the print signal and print data to be supplied to the printhead). A gate array (G.A.) 1704 controls supply of print data to the printhead IJH, and also controls data transfer between the interface 1700, the MPU 1701, and the RAM 1703.

A conveyance motor 1709 (not shown in FIG. 1) conveys the printing sheet P. A motor driver 1706 drives the conveyance motor 1709. A motor driver 1707 drives a carriage motor 1710. A head driver 1705 drives the printhead IJH. The head driver also outputs a logic signal serving as a control signal for variably setting the value of a constant electric current to be supplied to the heater of the printhead IJH to a predetermined value, and a control signal for controlling a switch provided to, for example, a voltage-to-current conversion circuit which generates a reference current. If the switch control signal is generated in the printhead, the printing apparatus main body need not transmit the signal.

The operation of the control arrangement will be explained. When the interface 1700 receives a print signal, the print signal is converted into print data for printing between the gate array 1704 and the MPU 1701. The motor drivers 1706 and 1707 are driven. At the same time, the printhead IJH is driven in accordance with the print data sent to the carriage HC, printing an image on the printing sheet P.

The embodiment employs a printhead having the structure as shown in FIG. 2. In every carriage scan, it is controlled to prevent printing by the printhead IJHK and that by the printhead IJHC from overlapping each other. In color printing, the printheads IJHK and IJHC are driven alternately in every scan. For example, when reciprocally scanning the carriage, it is controlled to drive the printhead IJHK in forward scan while driving the printhead IJHC in backward scan. Instead of this printhead driving control, another control may also be executed such that the print operation is performed in only forward scan and the printheads IJHK and IJHC are driven separately in two forward scan operations without conveying the printing sheet P.

The structure and operation of the head substrate integrated in the printhead IJH will be described.

Figure 5:
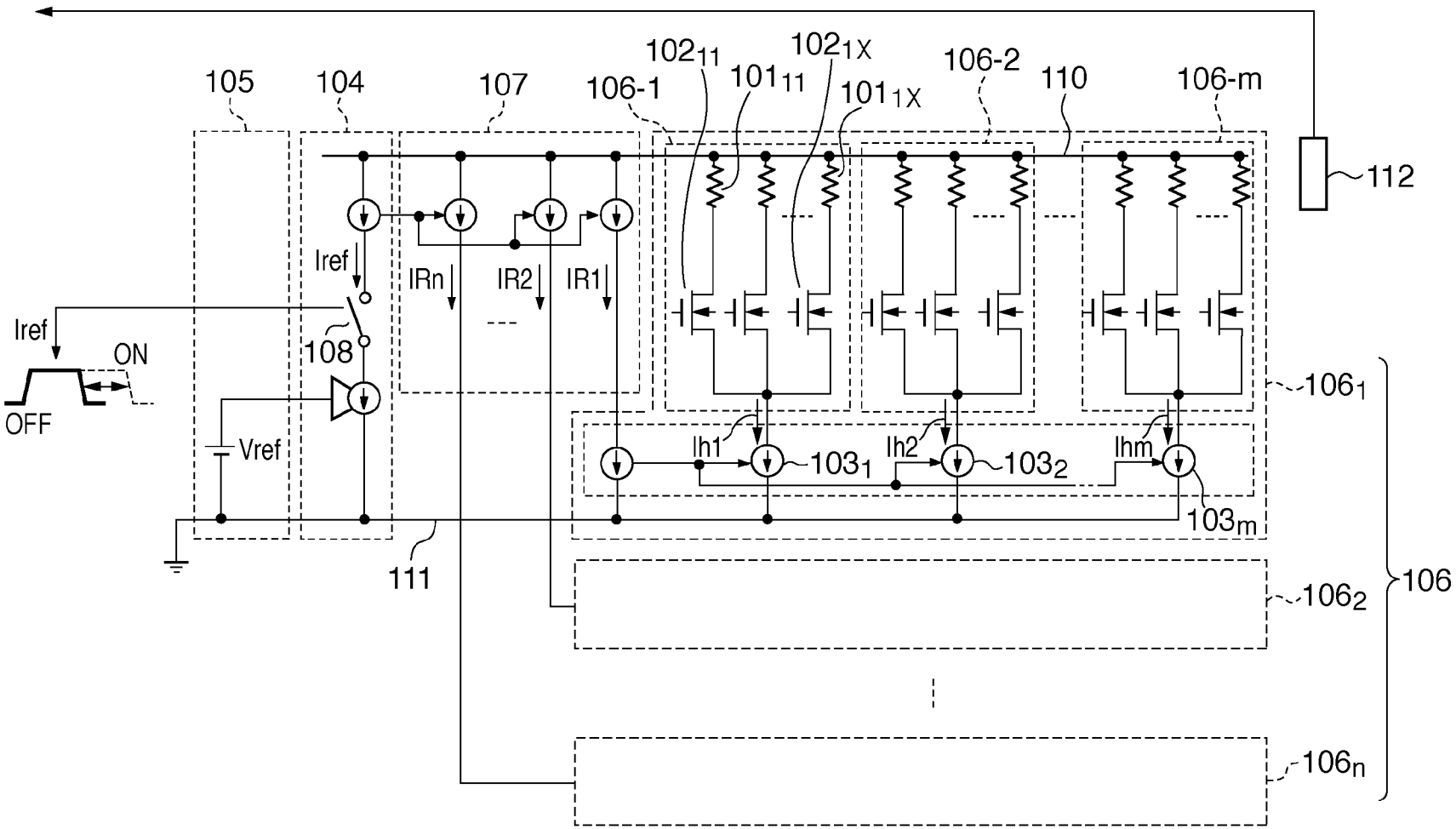
FIG. 5 is a circuit diagram showing the arrangement of a heater driving circuit provided on the head substrate of a printhead IJH.
Figure 13:
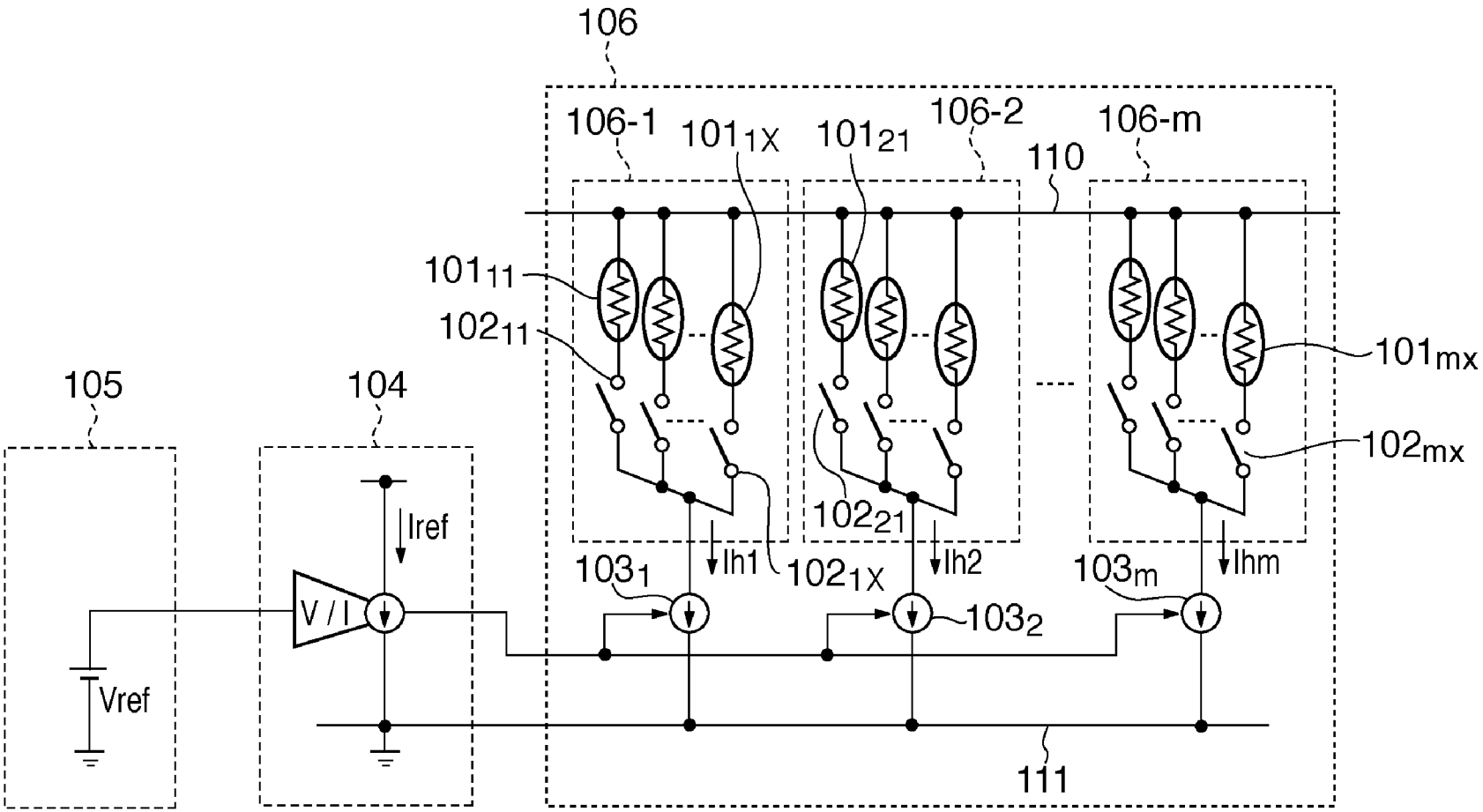
FIG. 13 is a circuit diagram showing the arrangement of the heater driving circuit of a conventional printhead.

FIG. 5 is a circuit diagram showing the arrangement of a heater driving circuit on the head substrate of the printhead IJH. In FIG. 5, the same reference numerals as those in FIG. 13 denote the same building elements, and a description thereof will not be repeated.

FIG. 5 shows a reference current generation circuit 107 in addition to a reference voltage circuit 105, voltage-to-current conversion circuit 104, and current source block 106. The current source block 106 includes n current source blocks $\mathbf{106}_1$ to $\mathbf{106}_n$ having the same arrangement. A switch 108 is inserted in the voltage-to-current conversion circuit 104 to control supply of a reference current $I_{ref}$. The open-close time of the switch, that is, the time for which the reference current is supplied is controlled from the outside of the head substrate (i.e., by the printing apparatus main body).

The voltage source of the reference voltage circuit 105 desirably outputs a voltage stable with respect to the power supply voltage or a temperature change. Thus, the reference voltage circuit 105 obtains a voltage stable with respect to the power supply voltage or a temperature change by using, for example, a band-gap voltage.

The reference current generation circuit 107 generates n reference currents IR1 to IRn on the basis of the reference current $I_{ref}$ generated by the voltage-to-current conversion circuit 104. In the embodiment, supply of the reference current $I_{ref}$ is ON/OFF-controlled by controlling the switch 108. At the same time, supply of the n reference currents IR1 to IRn generated based on the reference current $I_{ref}$ is also ON/OFF-controlled. Each of the n current source blocks includes m constant electric current sources $\mathbf{103}_1$ to $\mathbf{103}_m$ in correspondence with m groups 106 each including x heaters 101 and x switching elements 102.

The output terminals of the constant electric current sources $\mathbf{103}_1$ to $\mathbf{103}_m$ provided for the groups 106-1 to **106-*m* are connected to the common connection terminals of the groups in each of which the heaters 101 and switching elements 102 are series-connected. Each constant electric current source is connected to a GND line 111**.

The embodiment employs a MOSFET as the switching element 102. Energization to the heaters is controlled by enabling/disabling a control signal supplied to the gate of each MOSFET in each group. In accordance with the control signal, the output currents Ih1 to Ihm of the constant electric current sources $\mathbf{103}_1$ to $\mathbf{103}_m$ provided for the respective groups are supplied to desired heaters.

Constant electric current sources which operate MOS transistors in the saturated region are used as the constant electric current sources $\mathbf{103}_1$ to $\mathbf{103}_m$. Hence, the power supplies can be arranged even near the heaters, that is, in a region where the circuit integration density is high.

A sensor 112 is provided on the head substrate to detect the head temperature. An output from the sensor 112 is supplied to the printing apparatus main body and used for constant electric current driving. In the printing apparatus main body, the MPU or G.A. receives a head temperature, and determines, based on it, the time for which the reference current is supplied for constant electric current driving to be described in the following embodiments.

Note that FIG. 5 shows only one sensor, but a plurality of sensors may also be provided. For example, the sensor may also be provided for every n current source blocks, or at least one sensor may also be provided in each current source block. A sensor may also be provided in the printing apparatus main body to detect the ambient temperature of the printing apparatus in addition to the head temperature. The time for which the reference current is supplied can also be controlled based on the sensor output. The environmental temperature should be interpreted to include not only the head temperature but also the ambient temperature of the printing apparatus.

The operation of the heater driving circuit will be explained.

The m groups are driven and controlled by the same method, so x heaters $\mathbf{101}_{11}$ to $\mathbf{101}_{1x}$ belonging to the group 106-1 in the heater driving circuit shown in FIG. 5 will be exemplified.

Figure 6B:
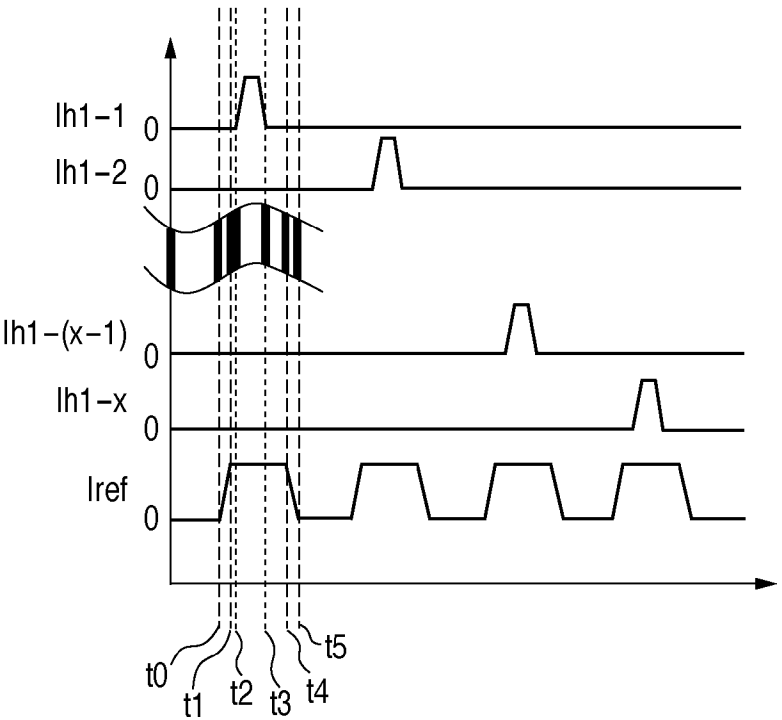
FIGS. 6A and 6B are timing charts showing the signal waveforms of control signals VGi supplied to the gates of switching elements (MOSFETs), a control signal VS to control a switch 108, and temporal changes in the amounts of currents flowing through respective heaters.
Figure 6A:
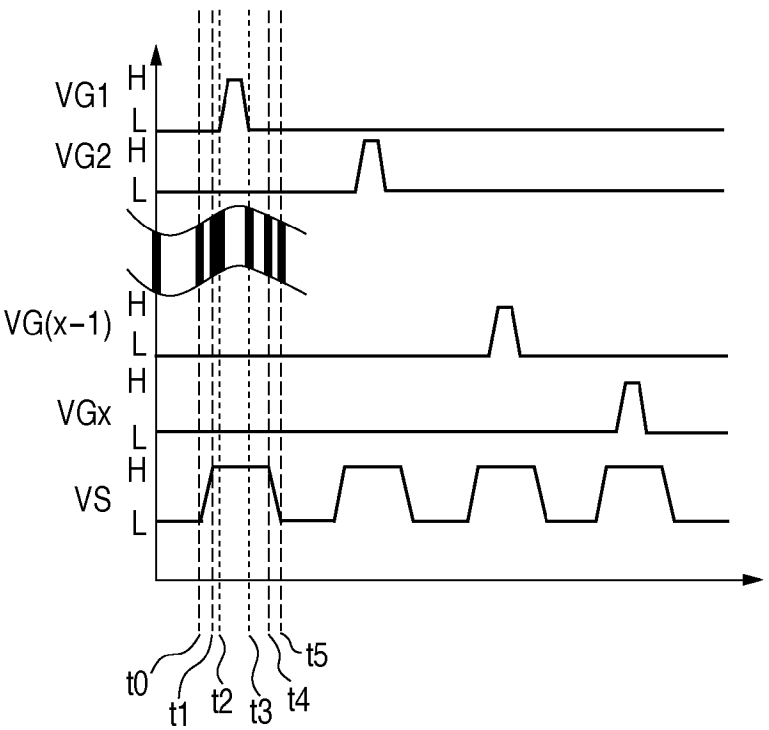

FIGS. 6A and 6B are timing charts showing the signal waveforms of control signals VGi supplied to the gates of switching elements (MOSFETs), a control signal VS to control the switch 108, and temporal changes in the amounts of currents flowing through the respective heaters.

FIG. 6A is a timing chart showing the signal waveforms of the control signals VGi supplied to the switching elements. FIG. 6B shows temporal changes in the amounts of currents flowing through the respective heaters.

Figure 7A:
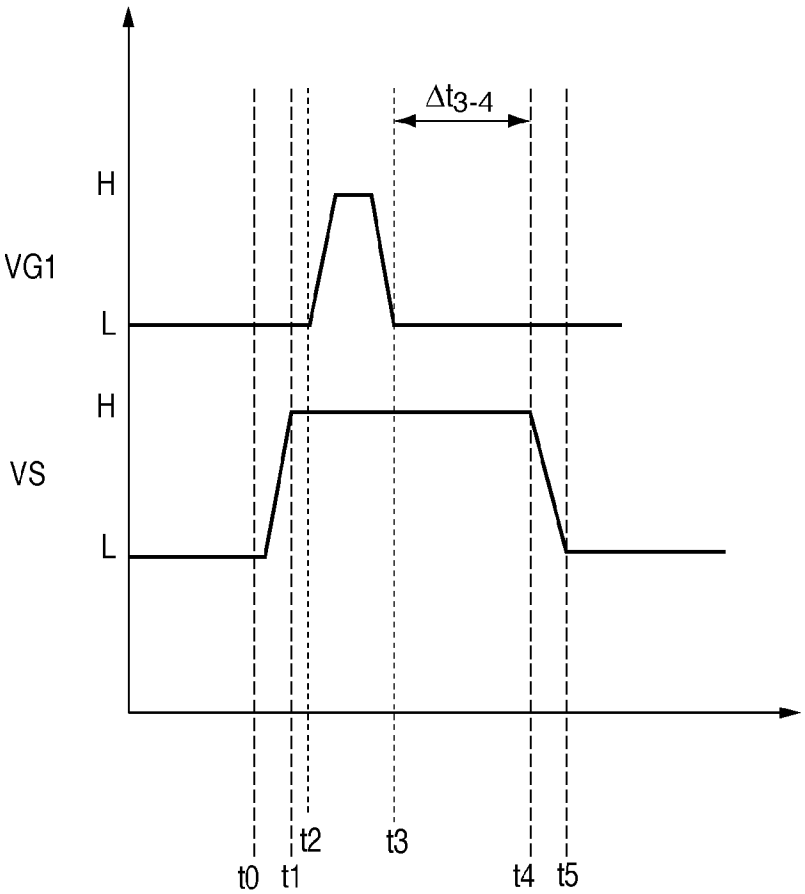
FIGS. 7A and 7B are timing charts showing only the relationship between the control signals VS and VG1 extracted from FIGS. 6A and 6B.
Figure 7B:
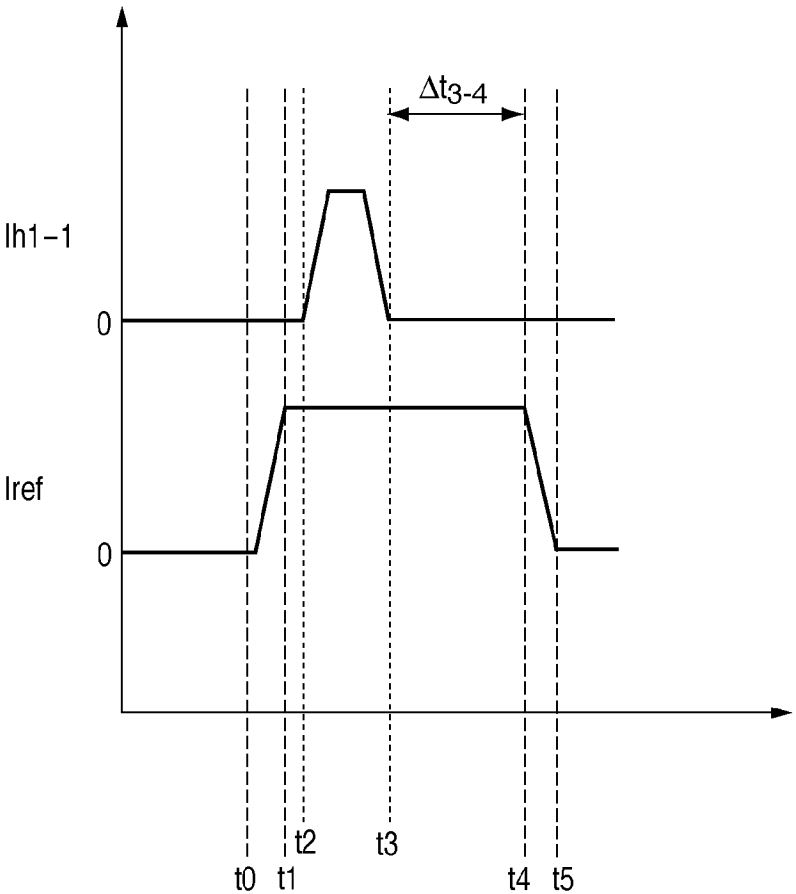

FIGS. 7A and 7B are timing charts showing only the relationship between the control signals VS and VG1 extracted from FIGS. 6A and 6B.

In FIG. 6A, VG1 to VGx are control signals to control ON (short-circuit) and OFF (open-circuit) of x switching elements $\mathbf{102}_{11}$ to $\mathbf{102}_{1x}$. When the control signal VGi is at high (H) level, a corresponding switching element is turned on (electrically connected). When the control signal VGi is at low (L) level, a corresponding switching element is turned off (electrically disconnected). Similarly, when the control signal VS is at high (H) level, the switch 108 is turned on (electrically connected). When the control signal VS is at low (L) level, the switch 108 is turned off (electrically disconnected).

In the example shown in FIG. 6A, all the heaters $\mathbf{101}_{11}$ to $\mathbf{101}_{1x}$ of the group 106-1 are sequentially driven.

Referring to FIG. 6A, at time t=t1, the control signal VS changes to high level, the reference current $I_{ref}$ flows, and the reference current is supplied to the constant electric current source $\mathbf{103}_1$. During the period of t1≦t<t2, all the gate control signals VG1 to VGx are at low level, so the output of the constant electric current source $\mathbf{103}_1$ and the heaters $\mathbf{101}_{11}$ to $\mathbf{101}_{1x}$ are open-circuited. Thus, no current flows through the heaters $\mathbf{101}_{11}$ to $\mathbf{101}_{1x}$.

During the period of t2≦t<t3, only the gate control signal VG1 changes to high level. Only the switching element $\mathbf{102}_{11}$ is short-circuited, and the output current Ih1 from the constant electric current source $\mathbf{103}_1$ flows through the heater $\mathbf{101}_{11}$. This state is represented by an output current Ih1-1 which rises during the period of t2≦t<t3 in FIG. 6B.

During the period of t3≦t, the control signal VG1 changes to low level again, and energization to the heater $\mathbf{101}_{11}$ stops. During the period of t4≦t, the control signal VS changes to low level. Supply of the reference current $I_{ref}$ stops, and supply of the reference current to the constant electric current source $\mathbf{103}_1$ also stops.

As described above, during the period of t1≦t<t2 immediately before energization to the heater $\mathbf{101}_{11}$, the reference current $I_{ref}$ is supplied to the constant electric current source $\mathbf{103}_1$. During the period of t2≦t<t3, a current is supplied to only the heater $\mathbf{101}_{11}$ to heat it. When energization to the heater $\mathbf{101}_{11}$ ends, supply of the reference current $I_{ref}$ stops during the period of t4≦t. In this process, ink near the heater $\mathbf{101}_{11}$ is heated to bubble. The ink is discharged from a nozzle in which the heater $\mathbf{101}_{11}$ is arranged, thereby printing a dot.

When the gate control signal VG2 changes to high level, the switching element $\mathbf{102}_{12}$ is short-circuited to supply the output current Ih1 from the constant electric current source $\mathbf{103}_1$ to the heater $\mathbf{101}_{12}$. This state is represented by the rise of the output current Ih1-2 in FIG. 6B.

In this way, gate control signals VGn sequentially change to high level to sequentially turn on the switching elements $\mathbf{102}_{11}$ to $\mathbf{102}_{1x}$. The output current Ih1 from the constant electric current source $\mathbf{103}_1$ is sequentially supplied to the heaters $\mathbf{101}_{11}$ to $\mathbf{101}_{1x}$, driving all the heaters $\mathbf{101}_{11}$ to $\mathbf{101}_{1x}$ belonging to the group 106-1.

In the above description, all the heaters $\mathbf{101}_{11}$ to $\mathbf{101}_{1x}$ in the group 106-1 are sequentially driven. In an actual print operation, only heaters necessary to form desired dots are driven. Hence, only when desired heaters are driven to print dots, control signals corresponding to the switching elements change to high level.

The above-described operation is executed similarly for the heaters belonging to the groups 106-2 to **106-*m***. Energization to the heaters can be controlled to selectively drive any desired ones of the (x×m) heaters.

First Embodiment

Figure 8:
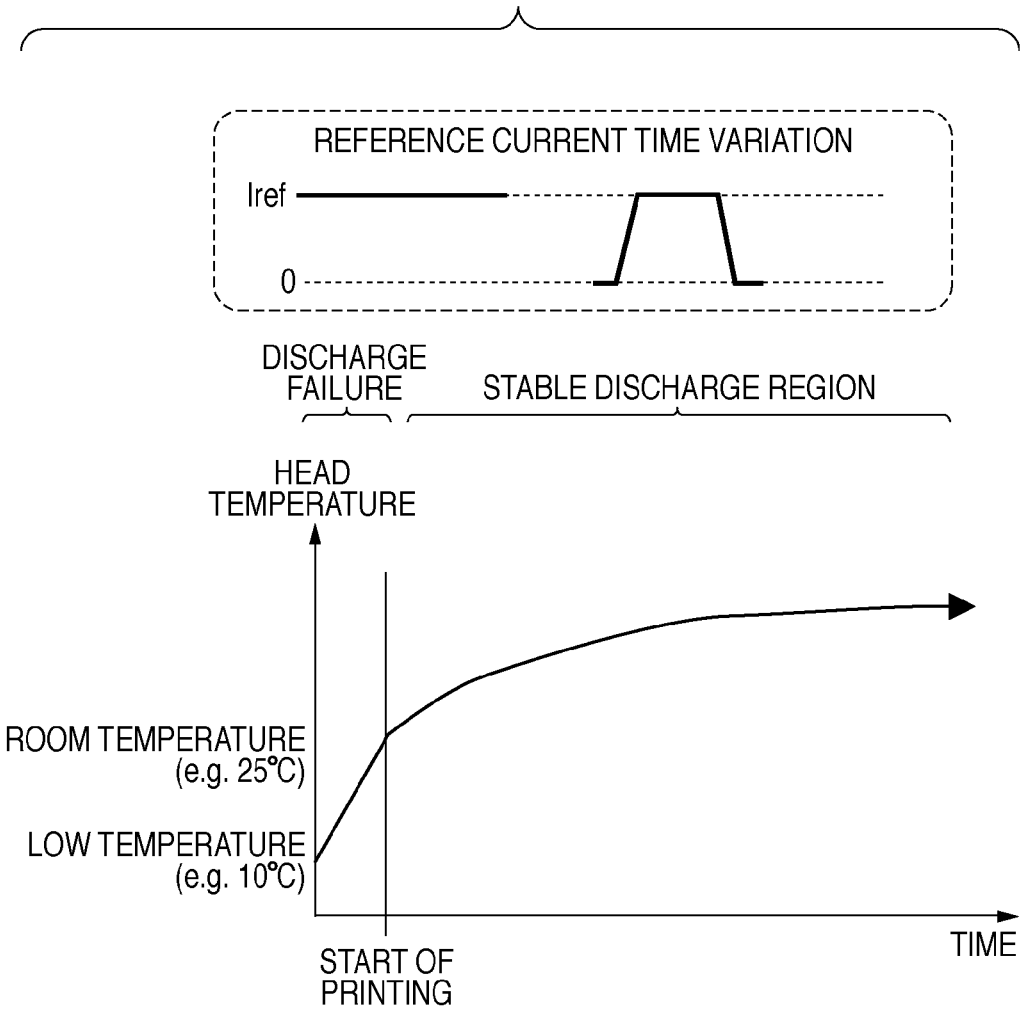
FIG. 8 is a graph for explaining control for executing constant electric current driving control when the environmental temperature is 10° C. according to the first embodiment.
Figure 9:
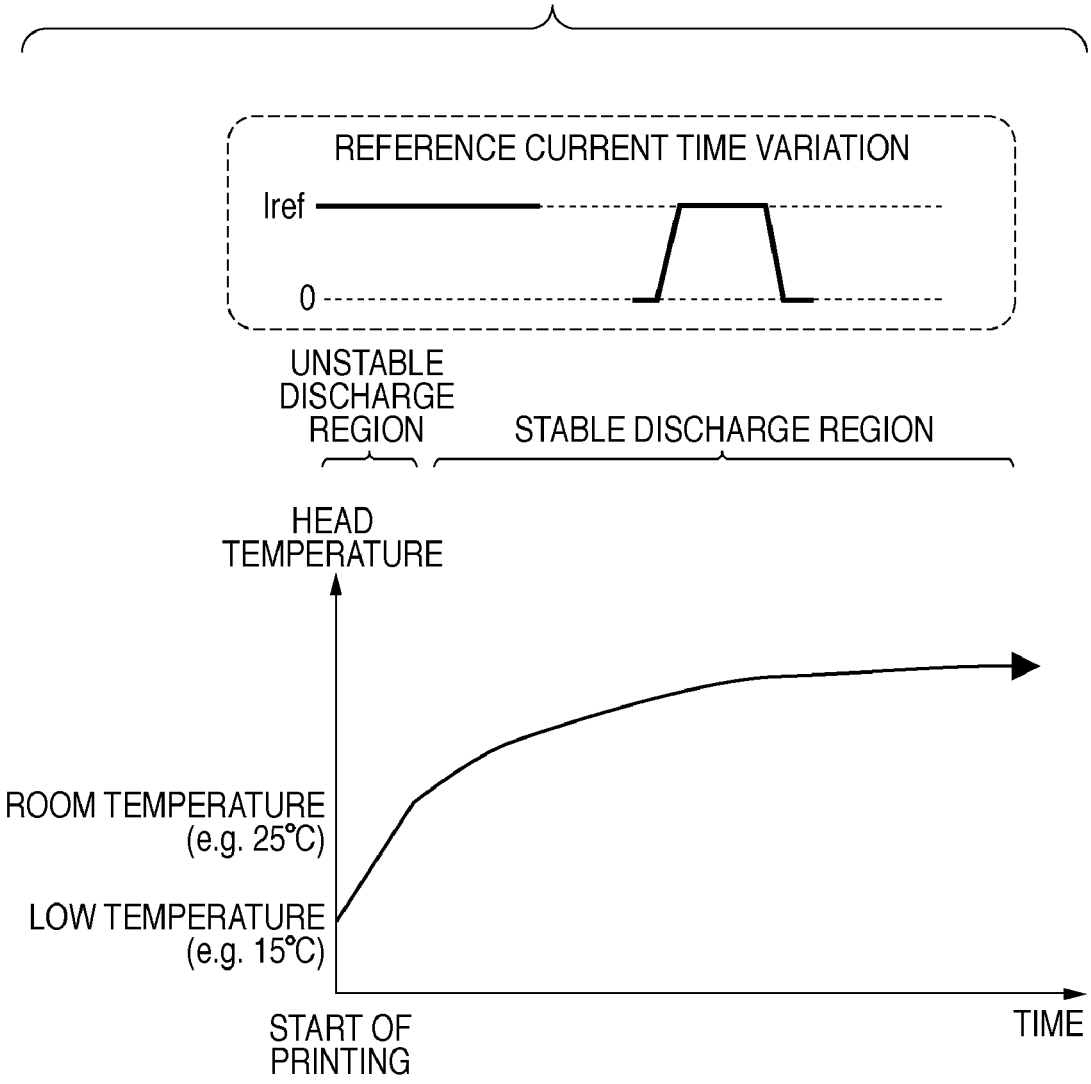
FIG. 9 is a graph for explaining control for executing constant electric current driving control when the environmental temperature is 15° C. according to the first embodiment.
Figure 10:
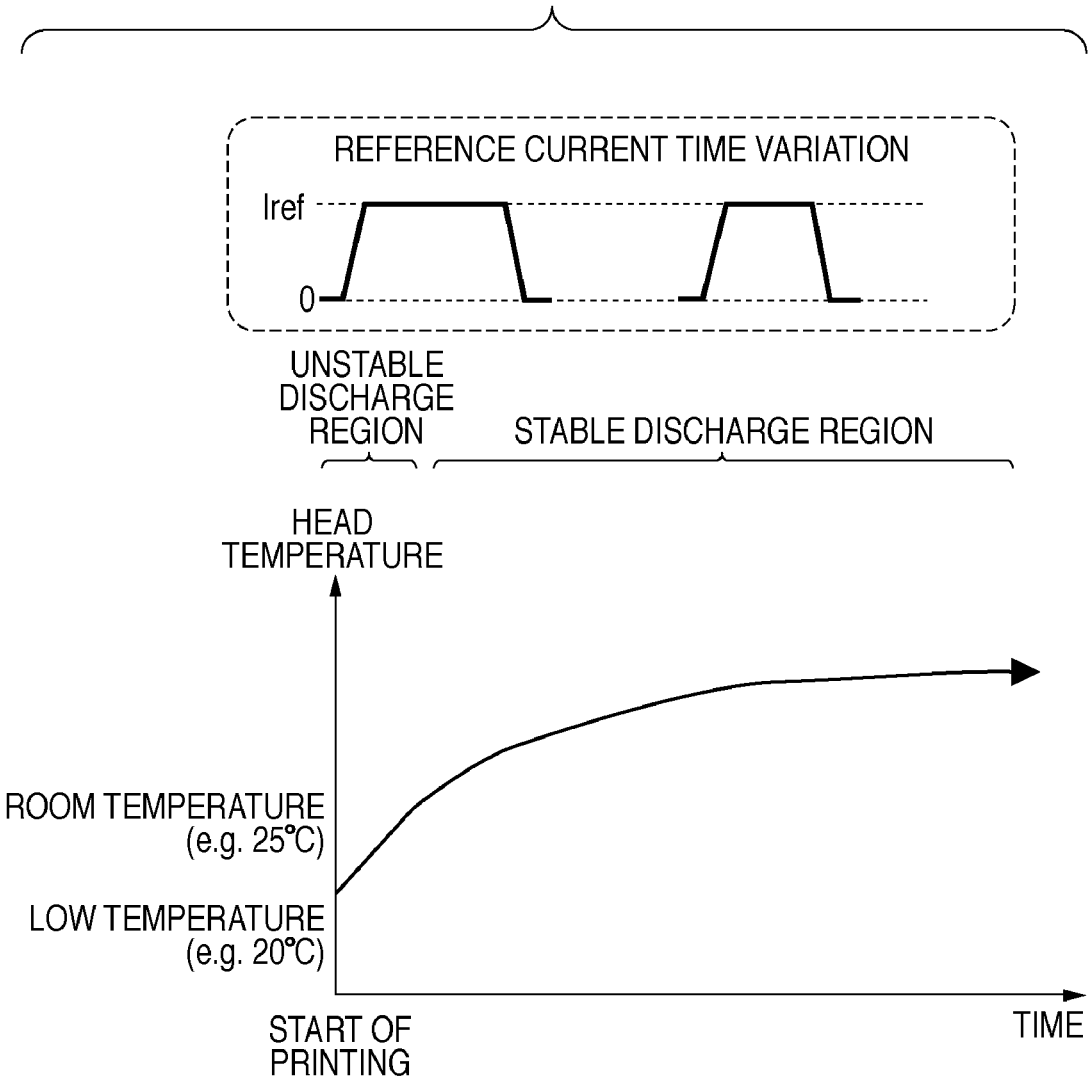
FIG. 10 is a graph for explaining control for executing constant electric current driving control when the environmental temperature is 20° C. according to the first embodiment.

FIGS. 8, 9, and 10 are graphs for explaining control for executing constant electric current driving control according to the first embodiment.

In the first embodiment, at a head temperature at which a discharge failure or unstable discharge occurs, a reference current $I_{ref}$ is supplied for a longer time than the normal one before printing or in the initial stage of the print operation, as shown in FIGS. 8 to 10. As a result, the heat generation amount in a reference current generation circuit 107 increases to keep the temperature of the head substrate. By keeping the temperature of the head substrate, the ink viscosity decreases to facilitate ink discharge.

A method of controlling the reference current supply time will be explained in detail with reference to FIGS. 7A and 7B.

As shown in FIG. 7A, the rise time t=t1 for the control signal VS is fixed to precede or coincide with the rise time t=t2 for the control signal VG1 to be supplied to a switching element, that is, to satisfy t1<t2. In a low-temperature environment, it is controlled to prolong a period $\Delta t_{3\text{-}4}$ during which the control signal VG1 changes to low level and then the control signal VS starts falling.

Figure 15A:
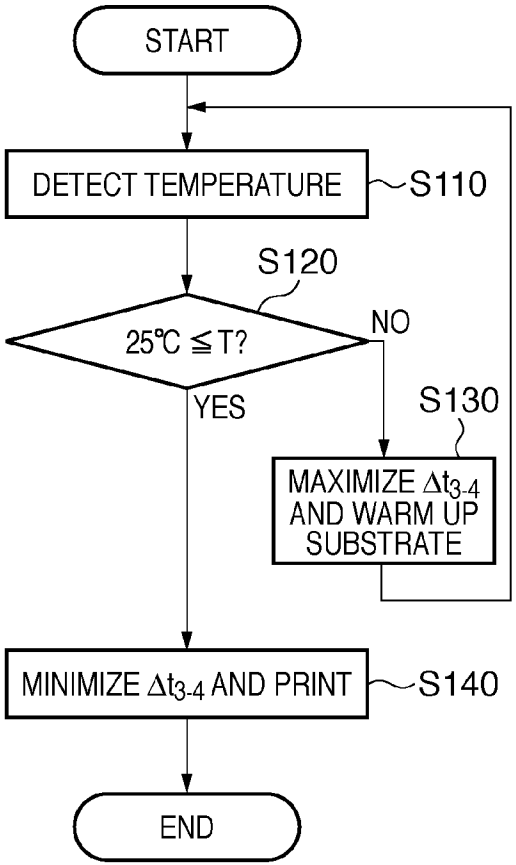
FIG. 15A is a flowchart showing a control sequence when the environmental temperature is 10° C. in the first embodiment.
Figure 15B:
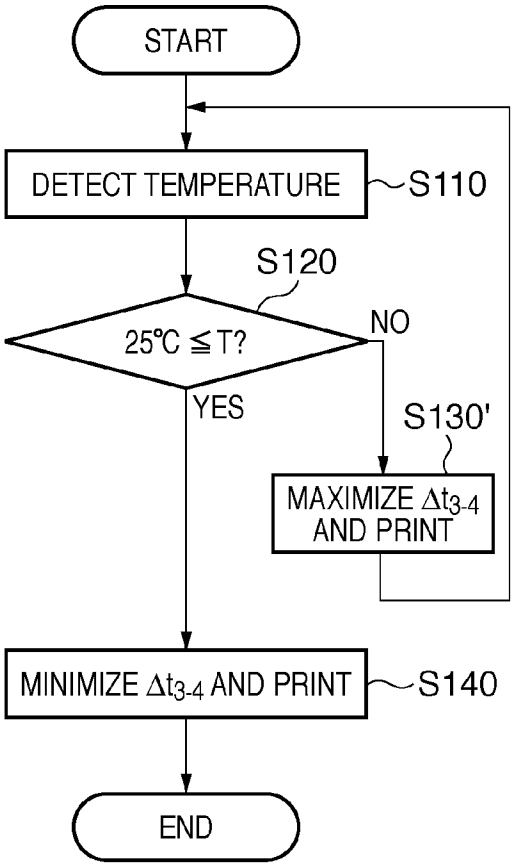
FIG. 15B is a flowchart showing a control sequence when the environmental temperature is 15° C. in the first embodiment.
Figure 15C:
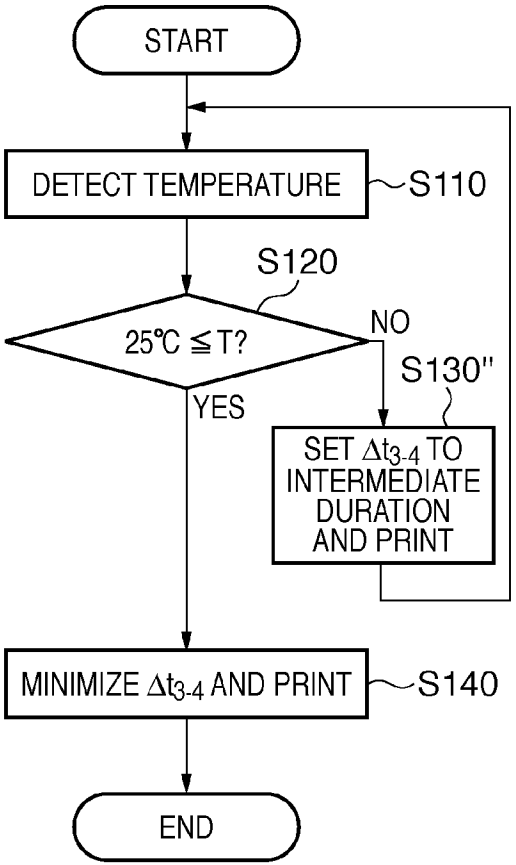
FIG. 15C is a flowchart showing a control sequence when the environmental temperature is 20° C. in the first embodiment.

FIGS. 15A, 15B, and 15C are flowcharts showing control operations from detection of a head temperature to printing in correspondence with FIGS. 8, 9, and 10.

FIG. 8 shows an example when the environmental temperature is 10° C. In this case, the reference current $I_{ref}$ is supplied before printing and kept supplied for a while even after the start of the print operation.

In the example shown in FIG. 8, actual control is executed as shown in FIG. 15A. More specifically, the head temperature is detected in step S110, and it is checked in step S120 whether the detected temperature T is equal to or higher than 25° C. If T<25° C., the process advances to step S130 to keep the energization time $\Delta t_{3\text{-}4}$ of the reference current $I_{ref}$ maximum (keep the switch ON), thereby keeping the temperature of the head substrate.

If T≧25° C., the process advances to step S140 to minimize the energization time $\Delta t_{3\text{-}4}$ and start printing.

By performing this control, the printhead is warmed up until the head temperature rises from the environmental temperature of 10° C. to the room temperature of 25° C. When the head temperature reaches 25° C. or more (stable discharge temperature), printing starts.

FIG. 9 shows an example when the environmental temperature is 15° C. In this case, the reference current $I_{ref}$ is supplied for a while at the start of the print operation.

In the example shown in FIG. 9, actual control is executed as shown in FIG. 15B. More specifically, the head temperature is detected in step S110, and it is checked in step S120 whether the detected temperature T is equal to or higher than 25° C. If T<25° C., the process advances to step S130' to maximize the energization time $\Delta t_{3\text{-}4}$ of the reference current $I_{ref}$ (keep the switch ON). Then, printing starts while keeping the temperature of the head substrate.

If T≧25° C., the process advances to step S140 to minimize the energization time $\Delta t_{3\text{-}4}$ and print.

By performing this control, printing is performed while warming up the printhead until the head temperature reaches the room temperature of 25° C. from the environmental temperature of 15° C. When the head temperature reaches 25° C. or more, the energization time $\Delta t_{3\text{-}4}$ is minimized to print.

FIG. 10 shows an example when the environmental temperature is 20° C. In this case, a pulse longer than the pulse of the reference current $I_{ref}$ supplied in a normal case where ink can be stably discharged is supplied in the initial stage of the print operation.

In the example shown in FIG. 10, actual control is executed as shown in FIG. 15C. More specifically, the head temperature is detected in step S110, and it is checked in step S120 whether the detected temperature T is equal to or higher than 25° C. If T<25° C., the process advances to step S130" to set the energization time $\Delta t_{3\text{-}4}$ of the reference current $I_{ref}$ to an intermediate duration. Then, printing starts while keeping the temperature of the head substrate.

If T≧25° C., the process advances to step S140 to minimize the energization time $\Delta t_{3\text{-}4}$ and print.

By performing this control, printing is performed while warming up the printhead until the head temperature reaches the room temperature of 25° C. from the environmental temperature of 20° C. When the head temperature reaches 25° C. or more, the energization time $\Delta t_{3-4}$ is minimized to print.

As described above, in any of the cases shown in FIGS. 8 to 10, when the head temperature is low, the head temperature is raised by prolonging the energization time $\Delta t_{3-4}$ of the reference current $I_{ref}$ before or immediately after the start of printing. The head temperature can immediately move from an unstable discharge temperature zone (low temperatures) of ink to a stable discharge temperature zone (room and high temperatures).

As a result, discharge from the printhead can come close to a discharge state at room temperature (25° C. or more).

The time for which the reference current is supplied is determined by the open-close time of a switch 108. The open-close time is controlled in accordance with a head temperature detected by a sensor 112. The reference current flows from a power supply line 110 into a GND line 111 during the period of time for which the switch 108 is ON. The reference current generation circuit 107 is driven for this time period, generating heat from the circuit. The generated heat warms up the head substrate.

Figure 14:
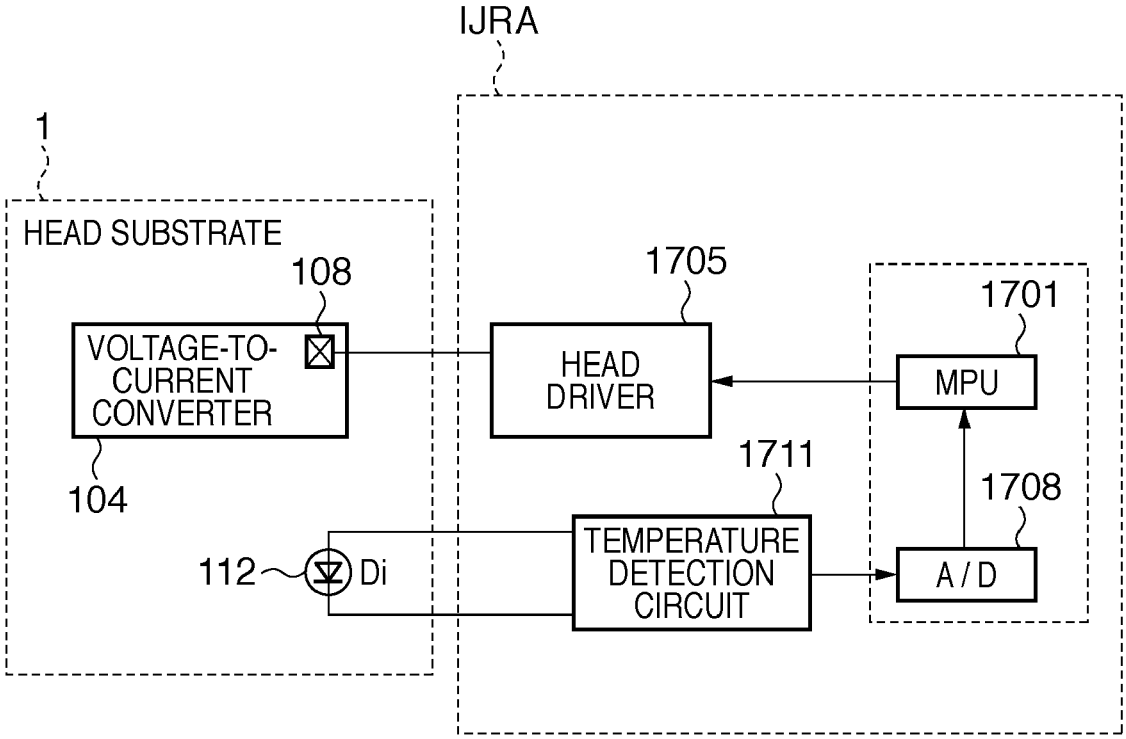
FIG. 14 is a block diagram for explaining a reference current switch and temperature control.

FIG. 14 is a block diagram showing the relationship between the sensor 112 and the switch 108 for controlling supply of the reference current $I_{ref}$. As shown in FIG. 14, the sensor 112 is assumed to be provided within a head substrate 1. FIG. 14 illustrates a diode sensor (Di) as the sensor 112.

An outline of reference current control based on a detected head temperature will be explained. As shown in FIG. 14, a constant electric current is supplied from the main body of a printing apparatus IJRA to the diode sensor (Di) 112 on the head substrate. A temperature detection circuit 1711 detects a voltage value (resistance value) at this time. The detected voltage is a temperature-dependent value, so the voltage value is converted into a temperature. After that, an A/D converter 1708 converts the detected temperature into a digital signal, and outputs the digital signal to an MPU 1701.

Based on the digital temperature signal, the MPU 1701 determines an ON/OFF signal (pulse width) for supplying a desired reference current $I_{ref}$. The MPU 1701 transmits the signal to the control switch 108 of a voltage-to-current converter 104 of the head substrate 1 via a head driver 1705. Subsequent heater driving control has been explained with reference to FIGS. 5, 6A, and 6B.

As described above, according to the first embodiment, high-quality printing can be achieved by suppressing occurrence of unstable discharge and a discharge failure in a low-temperature environment.

Second Embodiment

Figures 11A, 11B, 11C:
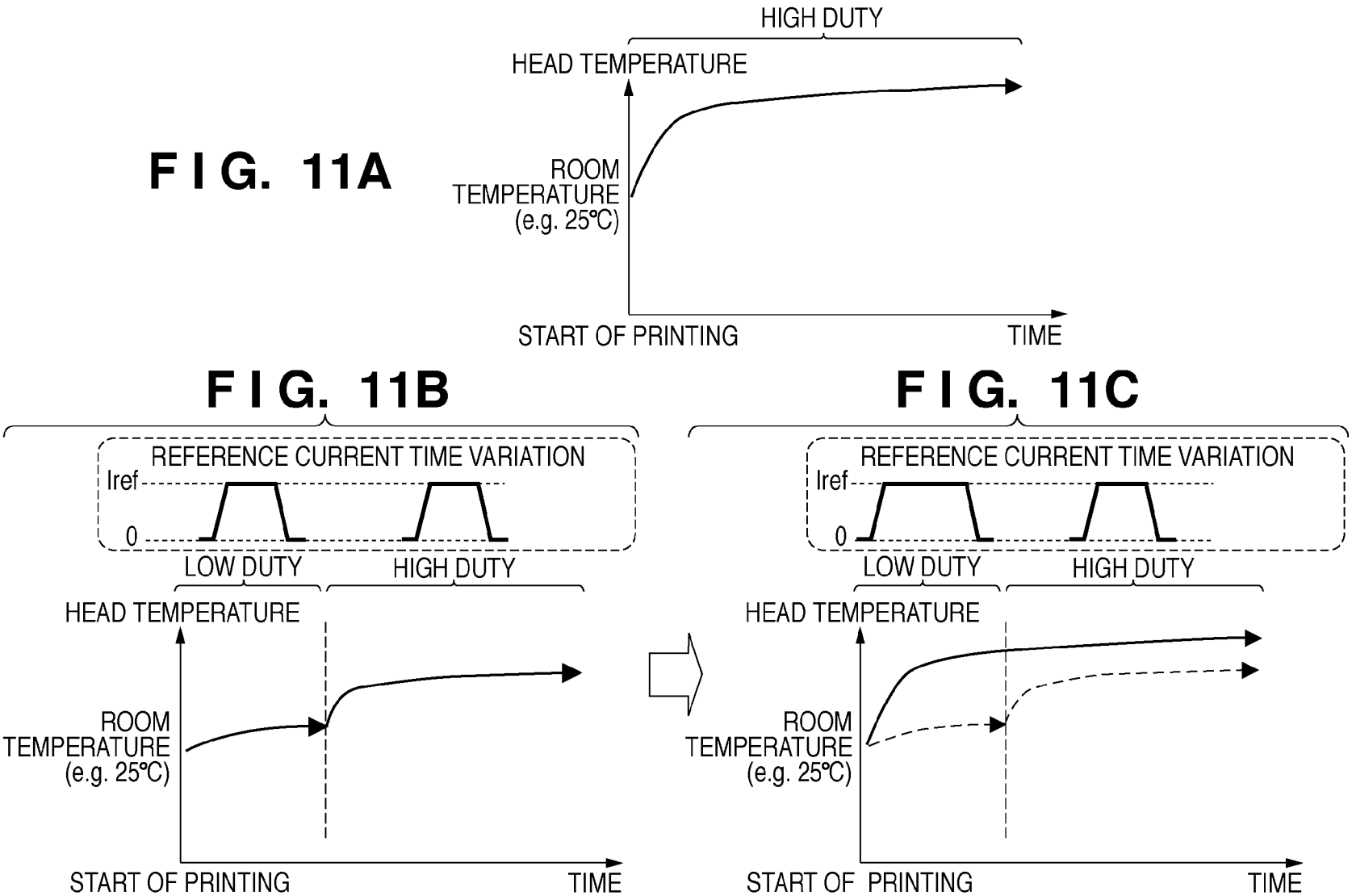
FIGS. 11A, 11B, and 11C are graphs for explaining control for executing constant electric current driving control according to the second embodiment.

FIGS. 11A to 11C are graphs for explaining control for executing constant electric current driving control according to the second embodiment.

FIG. 11A is a graph showing a temperature change of the printhead when a high-density image is printed (i.e., high-duty printing). As is apparent from FIG. 11A, the printhead temperature changes continuously and gradually.

FIG. 11B is a graph showing a temperature change of the printhead when a high-density image (high duty) is printed and a low-density image is printed (low duty) while keeping the reference current supply time constant regardless of a change of the print duty. As is apparent from FIG. 11B, the printhead temperature changes discontinuously. When the print duty (to be simply referred to as a duty hereinafter) changes discontinuously, the head temperature changes abruptly.

This is because the temperature rise characteristic of the head substrate differs between printing of a high-density image and that of a low-density image, and the ink discharge state changes. For this reason, dot formation for a high-density image and that for a low-density image differ from each other, degrading the image quality.

In the second embodiment, when printing both high- and low-density images, the reference current supply time is set short to decrease the heat generation amount of a reference current generation circuit 107 in printing the high-density image. In printing the low-density image, the reference current supply time is set long to increase the heat generation amount of the reference current generation circuit 107. With this setting, as shown in FIG. 11C, the printhead temperature always keeps a temperature characteristic (high-temperature stable discharge) close to a state (FIG. 11A) in which a high-density image is printed. A predetermined printing state is maintained regardless of the duty.

The duty value can be obtained by analyzing print data transmitted to the printing apparatus by the G.A. or MPU.

As described above, according to the second embodiment, a difference in head temperature rise characteristic depending on the print duty can be absorbed. Even if the duty changes, high-quality printing can be performed.

Third Embodiment

Figure 12B:
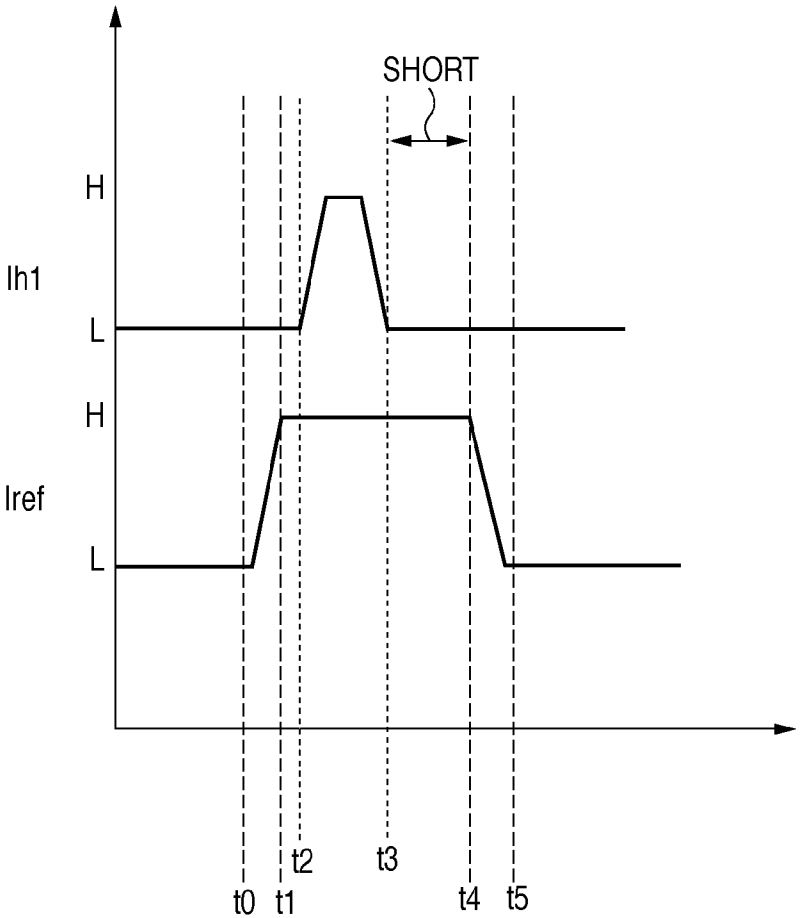
FIGS. 12A and 12B are timing charts for explaining control for executing constant electric current driving control according to the third embodiment.
Figure 12A:
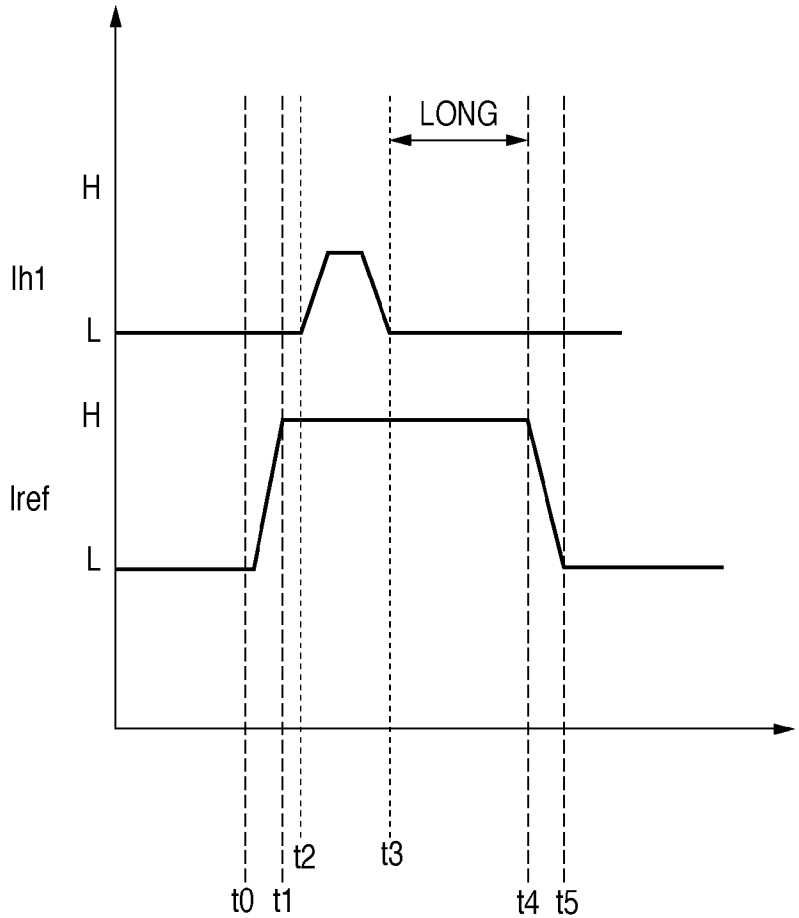

FIGS. 12A and 12B are timing charts for explaining control for executing constant electric current driving control according to the third embodiment.

A plurality of electrothermal transducers (heaters) provided on the head substrate of a printhead vary in heat generation characteristic. For example, ink discharge amounts corresponding to the respective heaters of the printhead which integrates a plurality of heaters sometimes vary. To correct such variations and obtain a stable ink discharge characteristic in each printhead, a non-volatile memory stores in advance a correction value for discharge considering manufacturing variations, and is integrated into the head substrate. The value (characteristic) for discharge control which reflects manufacturing variations is stored as a rank characteristic in the non-volatile memory (not shown) provided on the head substrate. When the printhead is mounted on the carriage, the printing apparatus reads out the rank characteristic from the non-volatile memory, and sets an appropriate reference current value in the printhead.

FIG. 12A is a timing chart showing the reference current supply time when the set current value is small. FIG. 12B is a timing chart showing the reference current supply time when the set current value is large.

In the third embodiment, for a printhead in which the set current value becomes large, the supply time of the reference current $I_{ref}$ is set short to decrease the heat generation amount of a reference current generation circuit 107, as shown in FIG. 12B. For a printhead in which the set current value becomes small, the supply time of the reference current $I_{ref}$ is set long to increase the heat generation amount of the reference current generation circuit 107, as shown in FIG. 12A.

As described above, according to the third embodiment, the reference current supply time is changed in accordance with the set current value. The temperature rise characteristics of printheads become almost equal to each other, eliminating the difference in printing state arising from the individual difference of the printhead. Thus, the tonality difference between printed images arising from the individual differences of the printheads can be eliminated.

Although the first to third embodiments have been described individually, the present invention is not limited to them. A head substrate having all the features of the first to third embodiments, a printhead using the head substrate, and a printing apparatus using the printhead can also be implemented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-097478, filed Apr. 3, 2008, which is hereby incorporated by reference herein in its entirety.

What is claimed is:

1. A head substrate comprising:

a plurality of printing elements;

a constant electric current source which generates a constant electric current used to drive said plurality of printing elements;

a reference current generation circuit which generates a reference current for generating the constant electric current;

a switching element which drives said plurality of printing elements by the constant electric current obtained by driving said constant electric current source in accordance with the reference current generated by said reference current generation circuit;

a switch which determines a time for which the reference current is generated; and a sensor which detects a temperature, wherein an open-close time of said switch is externally controlled in accordance with the temperature detected by said sensor.

2. The head substrate according to claim 1, wherein said printing element includes an electrothermal transducer.

3. The head substrate according to claim 1, wherein when the temperature is lower than a predetermined temperature, an ON/OFF operation of said switch is controlled to prolong the time for which the reference current is generated, and when the temperature is higher than the predetermined temperature, the ON/OFF operation of said switch is controlled to shorten the time for which the reference current is generated.

4. The head substrate according to claim 1, further comprising a non-volatile memory which stores a characteristic reflecting manufacturing variations, wherein the open-close time of said switch is controlled in accordance with the characteristic.

5. The head substrate according to claim 4, wherein as a value of the reference current is smaller, said switch is turned on in accordance with the characteristic so as to prolong the time for which the reference current is generated.

6. A printhead using a head substrate according to claim 1.

7. The printhead according to claim 6, wherein the printhead is an inkjet printhead which prints by discharging ink.

8. A head cartridge which integrates an inkjet printhead according to claim 7 and an ink tank containing ink to be supplied to the inkjet printhead.

9. A printing apparatus which uses an inkjet printhead according to claim 7, and prints by discharging ink from the inkjet printhead onto a printing medium.

10. The apparatus according to claim 9, further comprising:

means for analyzing externally transmitted print data to obtain a duty of printing by the printhead; and means for controlling the open-close time of said switch in accordance with the duty.

11. The apparatus according to claim 10, wherein when the duty is low, said controlling means controls to turn on said switch and prolong the time for which the reference current is generated.

* * * * *